US012276162B2

(12) United States Patent
Chouzenoux et al.

(10) Patent No.: US 12,276,162 B2
(45) Date of Patent: Apr. 15, 2025

(54) MULTI-STAGE WIRELESS COMPLETIONS

(71) Applicant: Schlumberger Technology Corporation, Sugar Land, TX (US)

(72) Inventors: Christian Chouzenoux, Clamart (FR); Alain Guelat, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/631,610

(22) Filed: Apr. 10, 2024

(65) Prior Publication Data

US 2024/0254840 A1 Aug. 1, 2024

Related U.S. Application Data

(63) Continuation of application No. 17/621,266, filed as application No. PCT/US2020/039338 on Jun. 24, 2020, now Pat. No. 11,982,132.

(60) Provisional application No. 62/866,555, filed on Jun. 25, 2019.

(51) Int. Cl.
*E21B 17/02* (2006.01)
*E21B 47/13* (2012.01)

(52) U.S. Cl.
CPC ..... *E21B 17/023* (2013.01); *E21B 17/0285* (2020.05); *E21B 47/13* (2020.05)

(58) Field of Classification Search
CPC ..... E21B 17/028; E21B 17/0285; E21B 17/0283; E21B 47/12; E21B 47/13; E21B 33/0385
See application file for complete search history.

(56) References Cited

U.S. PATENT DOCUMENTS

| | | | | |
|---|---|---|---|---|
| 4,839,644 | A | 6/1989 | Safinya | |
| 5,295,848 | A * | 3/1994 | Mohn | E21B 33/0355 439/247 |
| 6,160,492 | A * | 12/2000 | Herman | E21B 47/13 340/854.6 |
| 6,515,592 | B1 * | 2/2003 | Babour | E21B 47/12 340/854.6 |
| 6,684,952 | B2 | 2/2004 | Brockman | |
| 6,894,499 | B2 | 5/2005 | Dumont | |
| 7,165,618 | B2 | 1/2007 | Brockman | |
| 7,866,414 | B2 * | 1/2011 | Patel | E21B 47/12 166/50 |

(Continued)

FOREIGN PATENT DOCUMENTS

| | | | |
|---|---|---|---|
| WO | 0165069 | A1 | 9/2001 |
| WO | 2012107108 | A1 | 8/2012 |
| WO | 2018178689 | A1 | 10/2018 |

OTHER PUBLICATIONS

R. van Kleef et al., 2001, Water Flood Monitoring in an Oman Carbonate Reservoir Using a Downhole Permanent Electrode Array, Paper presented at the SPE Middle East Oil Show, Mar. 17-20, 2001, SPE 68078 (11 Pages).

(Continued)

*Primary Examiner* — Kipp C Wallace
(74) *Attorney, Agent, or Firm* — Jeffrey D. Frantz

(57) ABSTRACT

Wireless power and telemetry systems for multi-stage completions are provided. Various configurations for couplers, e.g., electro-magnetic couplers, for use in such systems are also provided.

14 Claims, 9 Drawing Sheets

(56) References Cited

U.S. PATENT DOCUMENTS

| | | | | |
|---|---|---|---|---|
| 7,902,955 | B2 | 3/2011 | Veneruso | |
| 8,074,743 | B2 | 12/2011 | Patel | |
| 8,230,735 | B2 | 7/2012 | Chouzenoux | |
| 8,988,178 | B2 * | 3/2015 | Deville | H01F 38/14 336/212 |
| 9,000,873 | B2 | 4/2015 | Deville | |
| 9,033,037 | B2 | 4/2015 | Deville | |
| 9,116,105 | B2 | 8/2015 | Veneruso | |
| 10,120,098 | B2 | 11/2018 | Luling | |
| 10,280,708 | B2 | 5/2019 | Lamb | |
| 11,982,132 | B2 | 5/2024 | Chouzenoux | |
| 2003/0066671 | A1 * | 4/2003 | Vinegar | E21B 47/12 363/178 |
| 2003/0227393 | A1 * | 12/2003 | Vinegar | E21B 34/066 340/854.3 |
| 2004/0060703 | A1 | 4/2004 | Stegemeier | |
| 2009/0151950 | A1 * | 6/2009 | Patel | E21B 41/0035 166/244.1 |
| 2010/0300678 | A1 | 12/2010 | Patel | |
| 2013/0098602 | A1 * | 4/2013 | Calderoni | E21B 17/00 166/242.1 |
| 2013/0192851 | A1 * | 8/2013 | Algeroy | E21B 47/13 166/242.6 |
| 2013/0321165 | A1 * | 12/2013 | Johannessen | E21B 17/003 340/854.4 |
| 2014/0218208 | A1 * | 8/2014 | Hudson | G01V 3/34 340/854.9 |

OTHER PUBLICATIONS

International Search Report and Written Opinion issued in PCT Application PCT/US2020/039338, dated Oct. 16, 2020 (22 pages).

Manara, Production and reservoir management system, 2015 (2 pages).

WellWacher Flux, Multizonal reservoir monitoring system, 2016 (2 pages).

* cited by examiner

MULTI-STAGE WIRELESS COMPLETIONS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority to U.S. Non-Provisional patent application Ser. No. 17/621,266 file Dec. 21, 2021, which is a National Stage of International Application No. PCT/US2020/039338, filed Jun. 24, 2020, which claims priority benefit of U.S. Provisional Application 62/866,555, filed Jun. 25, 2019, the entirety of each of which is incorporated by reference herein and should be considered part of this specification.

BACKGROUND

Field

The present disclosure relates to monitoring and control of subsurface installations located in one or more reservoirs of fluids such as hydrocarbons, and more particularly to methods and installations for providing wireless transmission of power and communication signals to, and receiving communication signals from, those subsurface installations.

Description of the Related Art

Reservoir monitoring includes the process of acquiring reservoir data for purposes of reservoir management. Permanent monitoring techniques are frequently used for long-term reservoir management. In permanent monitoring, sensors are often permanently implanted in direct contact with the reservoir to be managed. Permanent installations have the benefit of allowing continuous monitoring of the reservoir without interrupting production from the reservoir and providing data when well re-entry is difficult, e.g. subsea completions.

Permanent downhole sensors are used in the oil industry for several applications. For example, in one application, sensors are permanently situated inside the casing to measure phenomenon inside the well such as fluid flow rates or pressure.

Another application is in combination with so-called smart or instrumented wells with downhole flow control. An exemplary smart or instrumented well system combines downhole pressure gauges, flow rate sensors and flow controlling devices placed within the casing to measure and record pressure and flow rate inside the well and adjust fluid flow rate to optimize well performance and reservoir behavior.

Other applications call for using sensors permanently situated in the cement annulus surrounding the well casing. In these applications, formation pressure is measured using cemented pressure gauges; distribution of water saturation away from the well using resistivity sensors in the cement annulus; and seismic or acoustic earth properties using cemented geophones. Appropriate instrumentation allows other parameters to be measured.

These systems utilize cables to provide power and/or signal connection between the downhole devices and the surface. The use of a cable extending from the surface to provide a direct to connection to the downhole devices presents a number of well known advantages.

There are however, a number of disadvantages associated with the use of a cable in the cement annulus connecting the downhole devices to the surface including: a cable outside the casing complicates casing installation; reliability problems are associated with connectors currently in use; there is a risk of the cable breaking; the cable needs to be regularly anchored to the casing with cable protectors; the presence of a cable in the cement annulus may increase the risk of an inadequate hydraulic seal between zones that must be isolated; added expense of modifications to the wellhead to accommodate the feed-through of large diameter multi-conductor cables; the cables can be damaged if they pass through a zone that is perforated and it is difficult to pass the cable across the connection of two casings of different diameters.

In efforts to alleviate these and other disadvantages of downhole cable use, so-called "wireless systems" have been developed.

SUMMARY

The present disclosure provides wireless power and telemetry systems for multi-stage completions and various configurations for electro-magnetic couplers used in such systems.

In some configurations, a wireless transmission system for a multi-stage completion includes a surface power and telemetry system; an upper completion comprising a casing, a production tubing disposed within the casing, a tubing hanger supporting the production tubing, and an upper coupler; a lower completion comprising a production liner, a liner hanger disposed within the casing and supporting the production liner, a lower coupler, and one or more downhole devices; a first cable extending from the surface power and telemetry system to the upper coupler; and a second cable extending from the lower coupler to the one or more downhole devices. In use, power and telemetry signals flow from the surface power and telemetry system along the first cable to the upper coupler, thereby inducing a current in the production tubing such that the power and telemetry signals flow along the production tubing downhole to the lower coupler, the power and telemetry signals flow from the lower coupler along the second cable to the one or more downhole devices, and return telemetry signals flow from the lower completion along the casing to the surface power and telemetry system.

The lower coupler can be disposed around the production liner and positioned above the liner hanger. The lower coupler can be disposed within the production liner and positioned below the liner hanger. The one or more downhole devices can include one or more downhole gauges and/or one or more flow control valves.

In some configurations, a wireless transmission system for a multi-stage completion includes a surface power and telemetry system; an upper completion comprising a casing, a production tubing disposed within the casing, and a tubing hanger supporting the production tubing, wherein the tubing hanger has a first portion, a second portion, and an insulating gap between the first portion and the second portion; a lower completion comprising a production liner, a liner hanger disposed within the casing and supporting the production liner, a coupler, and one or more downhole devices; a first cable extending from the surface power and telemetry system to the first portion of the tubing hanger; a second cable extending from the coupler to the one or more downhole devices; and a third cable extending from the second portion of the tubing hanger to the surface power and telemetry system. In use, power and telemetry signals flow from the surface power and telemetry system along the first cable to the first portion of the tubing hanger, then along the production tubing downhole to the coupler, the power and telemetry signals flow from the coupler along the second cable to the one or more downhole devices, and return telemetry signals flow from the lower completion along the casing to the second portion of the tubing hanger and then along the third cable to the surface power and telemetry system.

In some configurations, a multi-stage completion includes an upper completion comprising a casing, a production tubing disposed within the casing, a tubing hanger supporting the production tubing, and an upper coupler; and a lower completion comprising a production liner, a liner hanger disposed within the casing and supporting the production liner, a lower coupler, and one or more downhole devices. In use, power and telemetry signals flow from a surface power and/or telemetry system to the upper coupler, thereby inducing a current in the production tubing such that the power and telemetry signals flow along the production tubing downhole to the lower coupler, the power and telemetry signals flow from the lower coupler to the one or more downhole devices, and return telemetry signals flow from the lower completion along the casing to the surface power and telemetry system.

The lower coupler can be disposed around the production liner and positioned above the liner hanger. The lower coupler can be disposed within the production liner and positioned below the liner hanger. The one or more downhole devices can include one or more downhole gauges and/or one or more flow control valves.

Couplers for wireless power and telemetry transmission systems and/or for multi-stage completions can have various configurations. A coupler can include an outer housing and a plurality of toroidal transformers disposed about a tubing mandrel and within the housing.

The housing can be made of steel. The housing can include an insulating sleeve.

A space within the housing and surrounding the transformers can be filled with an inert gas at atmospheric pressure. A space within the housing and surrounding the transformers can be filled with an insulating material.

The tubing mandrel can be made of metal. The tubing mandrel can be an insulating sleeve.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
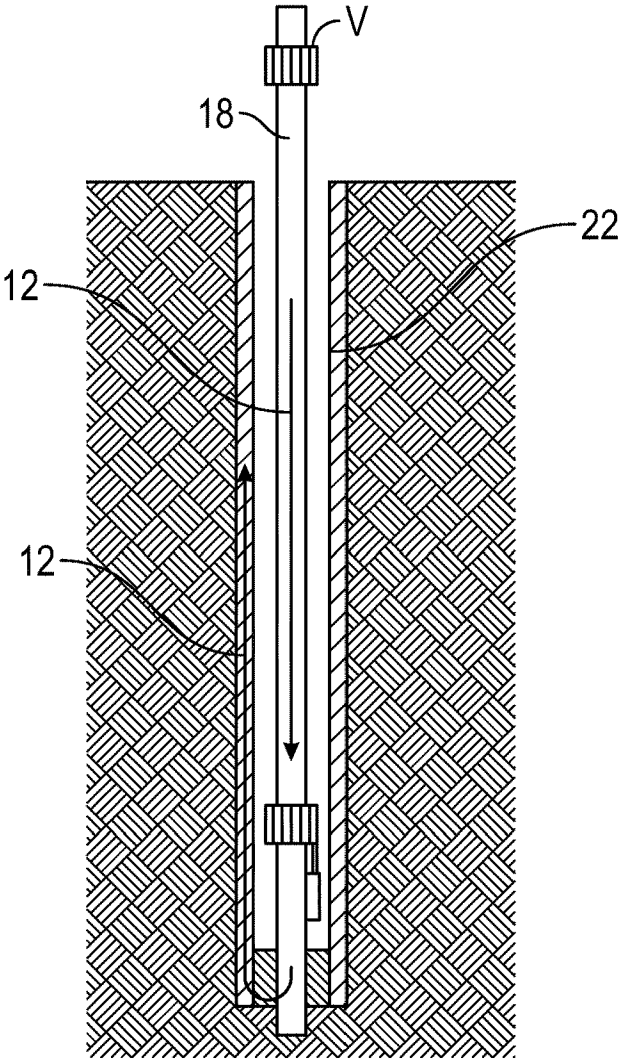
FIG. 1 illustrates an example wireless transmission system.

FIG. 1 illustrates a tubing-casing transmission system, or a wireless two-way communication system, in which an insulated system of tubing and casing serve as a coaxial line. Additional details regarding such a tubing-casing transmission system can be found in U.S. Pat. No. 4,839,644, which is hereby incorporated herein by reference. Both power and two-way communication (telemetry) signal transmission are possible in the tubing-casing system. As shown, tubing 18, e.g., production tubing, is installed in a casing string 22. In use, injected current flows along current lines 12.

U.S. Pat. No. 6,515,592, which is hereby incorporated herein by reference, also describes methods and systems for power and/or signal transmission for permanent downhole installations. In some systems and methods described therein, an electrically conductive conduit is disposed in the well, and a section of the conduit is electrically insulated by encapsulating the section with an insulating layer and insulating the encapsulated section from an adjoining section of the conduit by using a conduit gap. At least one downhole device is connected or coupled to the insulated section. In use, an electrical signal is introduced within the insulated section of the conduit, travels to the at least one downhole device, and returns via a return path. The electrical signal can be introduced to the conduit directly or via inductive coupling. The return path can be provided through, for example, the earth formation surrounding the well, a cement annulus, or an outer conductive layer of the conductive conduit.

Figure 2:
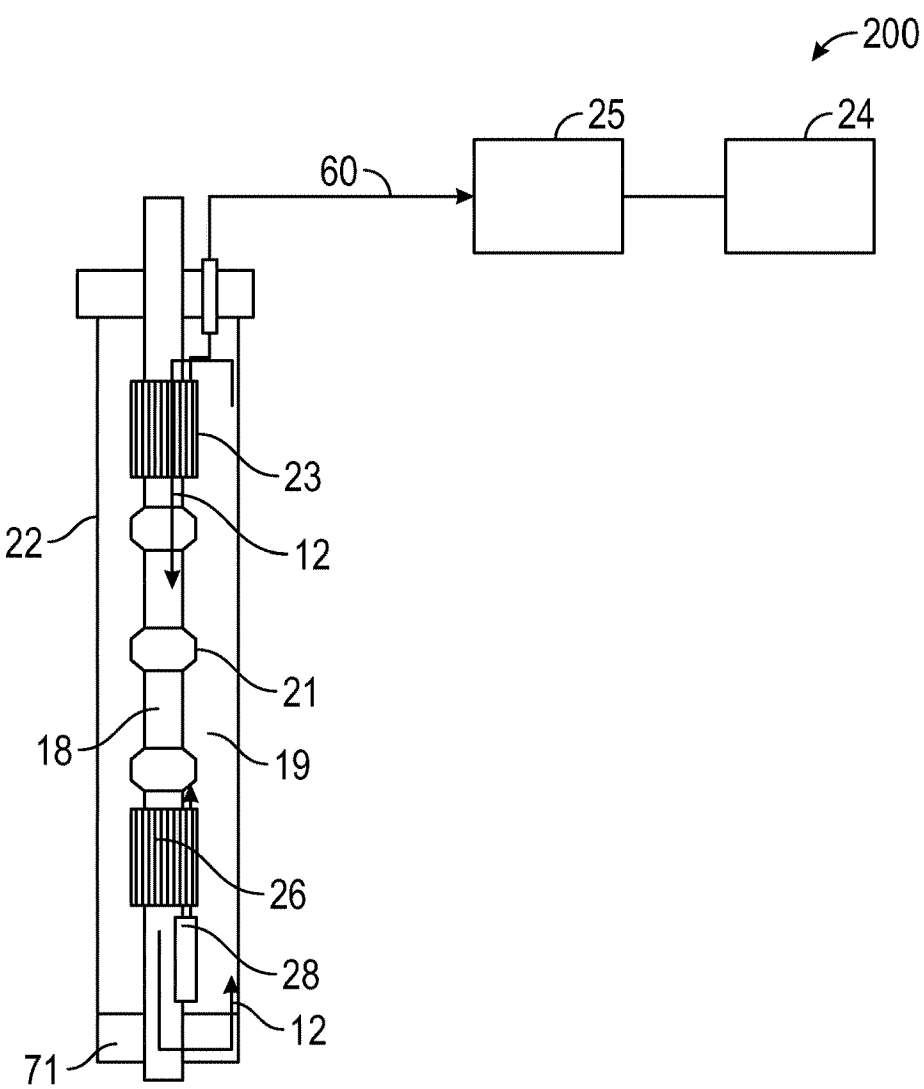
FIG. 2 illustrates an example wireless transmission system.

FIG. 2 illustrates another example of a wireless transmission system 200. As shown, production tubing 18 is installed in casing 22. In use, the tubing 18 serves as the conductive conduit and the casing 22 serves as the return path for electrical signal(s) flowing along current lines 12 and providing power transmission to and/or communication with a downhole device 28. The tubing 18 is electrically isolated from the casing 22 by, for example, non-conductive or insulating fluid 19 in the interior annulus (the space between the tubing 18 and casing 22), non-conductive or insulating centralizers 21 disposed about the tubing 18, and/or an insulating coating on the tubing 18. A conductive packer 71 establishes an electrical connection between the tubing 18 and the casing 22 for the electrical signal return path.

An upper coupler (e.g., electro-magnetic coupler) 23 is linked to a surface modem and power supply 24 by a cable 60. In use, current is injected into upper coupler 23 via or from source 24 through the cable 60, thereby inducing a current in tubing 18. The induced current flows along current paths 12 through the tubing to a lower coupler (e.g., electromagnetic coupler) 26. The induced current flowing through the tubing 18 inductively generates a voltage in the lower coupler 26 that is used to provide power and/or communication to the downhole device 28. Communication signals from the downhole device 28 induce a second voltage in the lower coupler 26, which creates a second current. The second current flows along current paths 12 from the lower coupler 26, through the tubing 18, through the conductive packer 71, and along the return path through the casing 22 to a surface electronic detector 25 to be recorded, stored, and/or processed.

Figure 3:
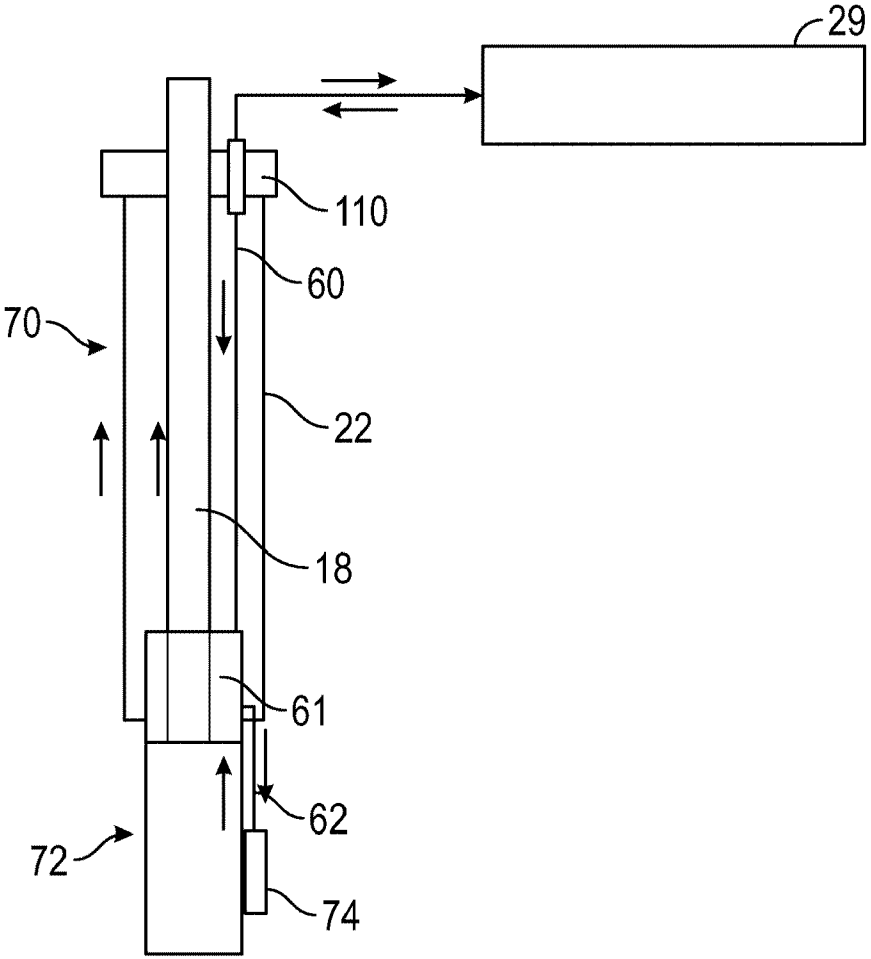
FIG. 3 illustrates an example wired multi-stage completion.

FIG. 3 illustrates an example of a multi-stage wired transmission system including an upper completion 70 and a lower completion 72. The lower completion 72 includes various reservoir monitoring and control tools 74. As shown, the upper completion includes a tubing hanger 110 supporting production tubing 18. In use, power and telemetry current flows from a surface power and telemetry system 29 through a cable 60, which extends through the tubing hanger 110 to an inductive coupler pair 61. The inductive coupler pair 61 can be positioned at or near a bottom of the upper completion 70 or at or near a junction of the upper completion 70 and the lower completion 72. Power flows from the inductive coupler pair 61 to the tools 74 along a cable 62. Telemetry signals can also flow to and from the tools 74 along cable 62.

The present disclosure provides wireless transmission systems and methods for providing power to and/or communication with one or more downhole devices 28 in multi-stage completions. In some such systems and methods, the casing 22 is deployed in the well, then the tubing 18 is deployed within the casing 22 in separated runs, leading to a multi-stage completion. Similar to the system 200 of FIG. 2, the tubing 18 and casing 22 in systems for wireless multi-stage completions can serve as a coaxial line for transmission of power and telemetry signals.

Figure 4:
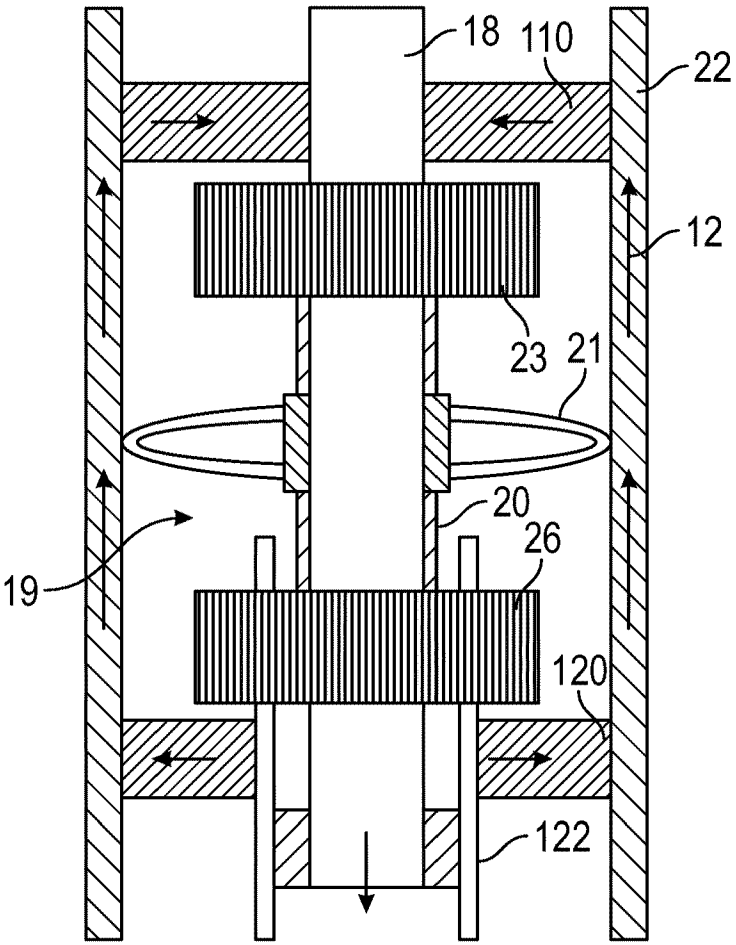
FIG. 4 illustrates an example multi-stage wireless transmission system.

FIG. 4 illustrates an example of a multi-stage wireless transmission system. A tubing hanger 110 at or near the top of the production string or in the upper completion supports the tubing 18. The tubing hanger 110 and/or an upper production packer also acts as an upper section short between the casing 22 and tubing 18. A liner hanger 120 provides attachment for and/or supports the production liner 122, which may be a metallic, e.g., steel, pipe, for the lower completion. The liner hanger 120 and/or a lower production packer act as a lower section short between the tubing 18 and the casing 22. The upper section short and lower section short close the tubing-casing system current loop.

As shown, the tubing 18 can be at least partially coated with an insulating coating (e.g., a polyamide material (Rilsan type)) 20, an insulating fluid 19 can be disposed in the annular space, and/or non-conductive or insulating centralizers 21 can be disposed about the tubing 18. Couplers 23, 26 provide electrical coupling between the tubing-casing transmission line and the surface and/or downhole device(s). The couplers 23, 26 can be or include toroidal transformers electrically coupled to the tubing-casing line for receiving and/or transmitting power and/or telemetry signals.

In the illustrated configuration, the multi-stage wireless transmission system includes an upper coupler 23 and a lower coupler 26. The upper coupler 23 is driven by surface electronics (e.g., AC power supply and control electronics, such as source 24 and detector 25). The upper coupler 23 can transmit and detect low frequency signals (e.g., AC current) propagating along the pipe to the lower coupler 26. The lower coupler 26 is connected to downhole electronics, e.g., downhole device(s) 28, for detection of telemetry signals, recovery of electrical power, and/or uplink data transmission. The lower completion can also include a battery or any type of energy storage device. Such a storage device can store power transmitted from the surface (e.g., the source 24) along the pipe. Any type(s) of modulation/demodulation technique(s) (e.g., FSK, PSK, ASK) can be used for communication between the upper 23 and lower 26 couplers. Multi-stage wireless transmission systems and methods according to the present disclosure therefore establish wireless communication between lower and upper sections of the production string.

Figure 6:
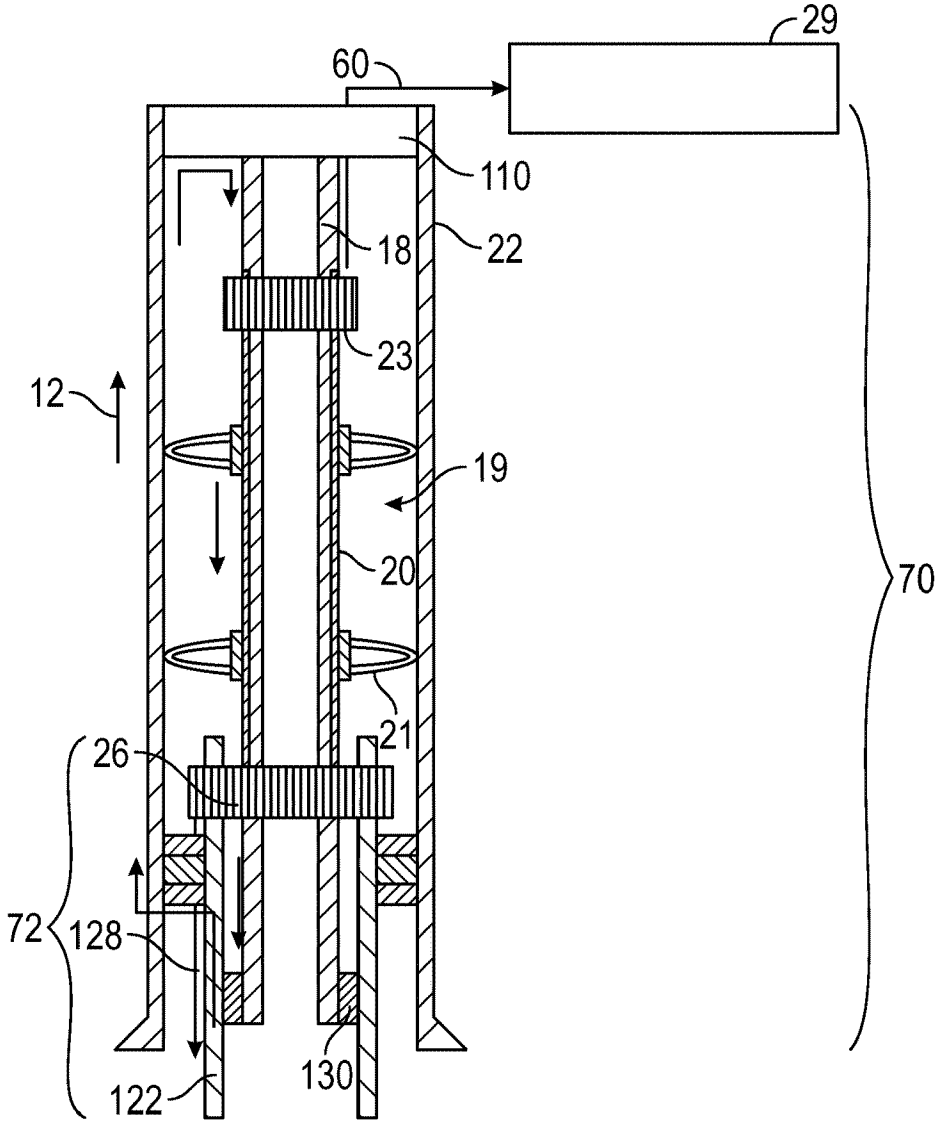
FIG. 6 illustrates an example multi-stage wireless transmission system.
Figure 5:
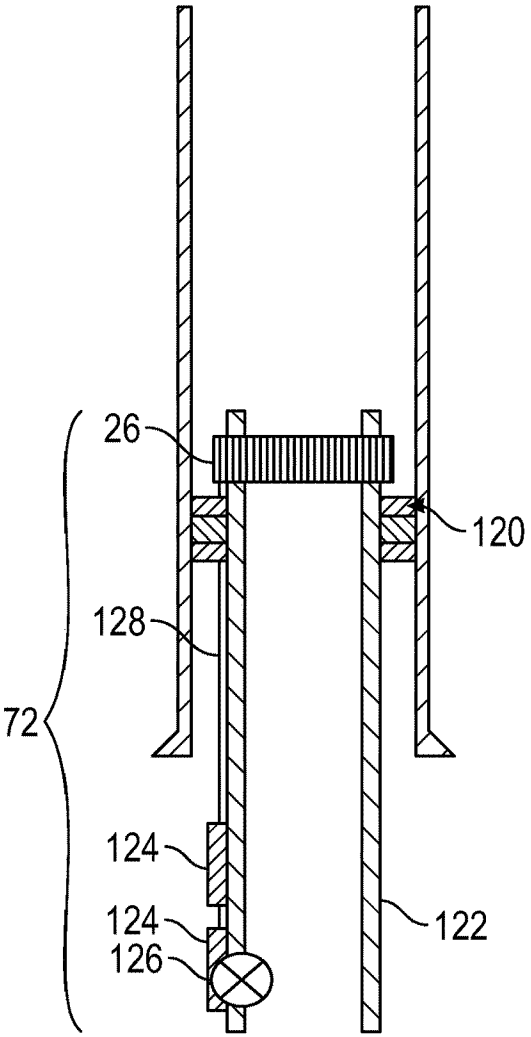
FIG. 5 illustrates a lower completion section of an example multi-stage wireless transmission system.

FIGS. 5 and 6 illustrate an example of a multi-stage wireless transmission system that can include some or all of the features of the system of FIG. 4. As shown in FIG. 5, the lower completion 72 includes a production liner 122 supported by a liner hanger 120. The lower completion 72 also includes one or more gauges 124 and/or electro-mechanical flow control valves 126 disposed downhole of the liner hanger 120, for example, in, along, or adjacent the production liner 122. The lower coupler 26 surrounds the production liner 122 and is positioned above the liner hanger 120. Electrical wiring 128, e.g., a permanent cable, extends from the lower coupler 26 to the downhole gauges 124 and/or flow control valves 126. The liner hanger 120 includes an electrical feed-through or penetration for the electrical wiring 128.

FIG. 6 shows the upper completion 70 deployed in the well and coupled with the lower completion 72 of FIG. 5. A tubing hanger 110 at or near the top of the production string or in the upper completion 70 supports the tubing 18. The tubing 18 can be at least partially coated with an insulating coating (e.g., a polyamide material (Rilsan type)) 20, an insulating fluid 19 can be disposed in the annular space, and/or non-conductive or insulating centralizers 21 can be disposed about the tubing 18. A surface power and telemetry system 29 is connected to the upper coupler 23 via a cable 60. A latch mechanism, or tubing seal bore receptacle, 130 is disposed between the tubing 18 and the production liner 122 at or near the bottom of the tubing 18. The tubing hanger 110 and latch mechanism 130 can act as shorts between the tubing 18 and casing 22 in use.

Figure 8:
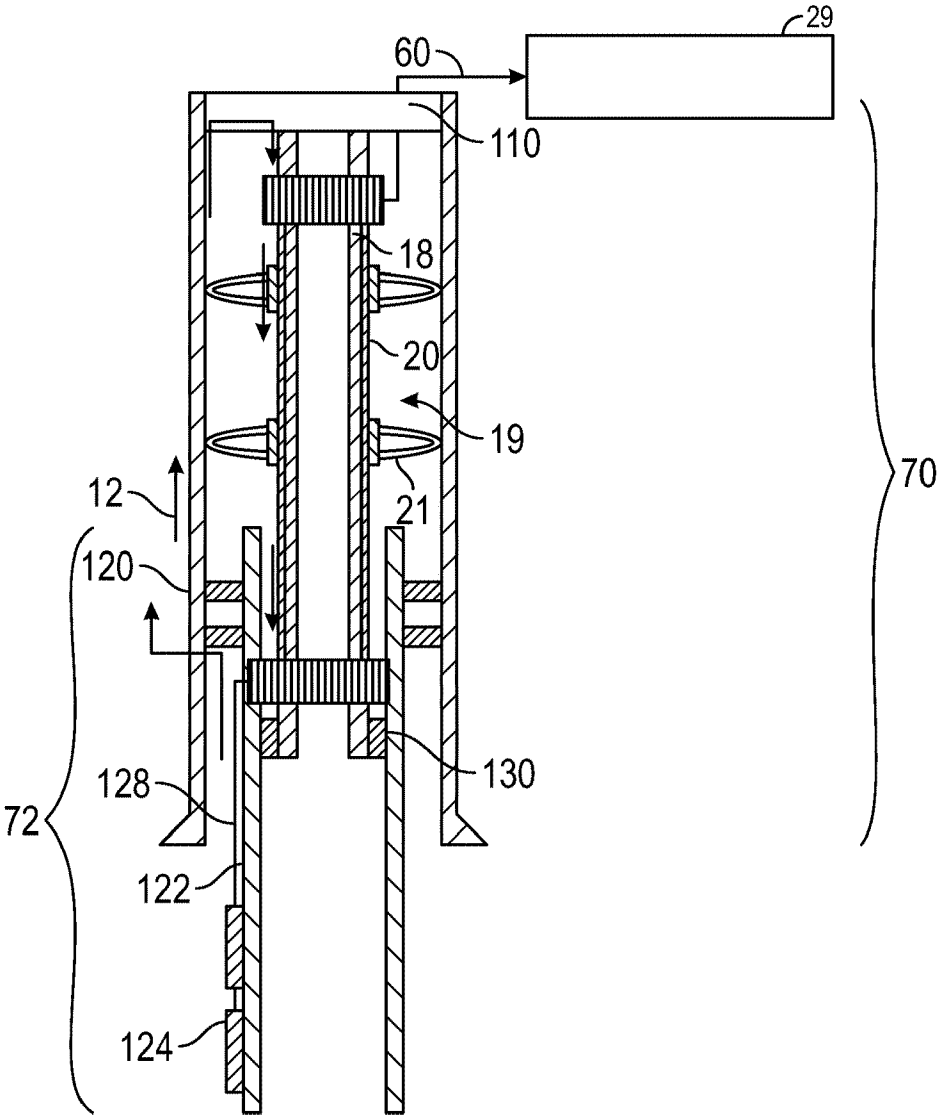
FIG. 8 illustrates an example multi-stage wireless transmission system.
Figure 7:
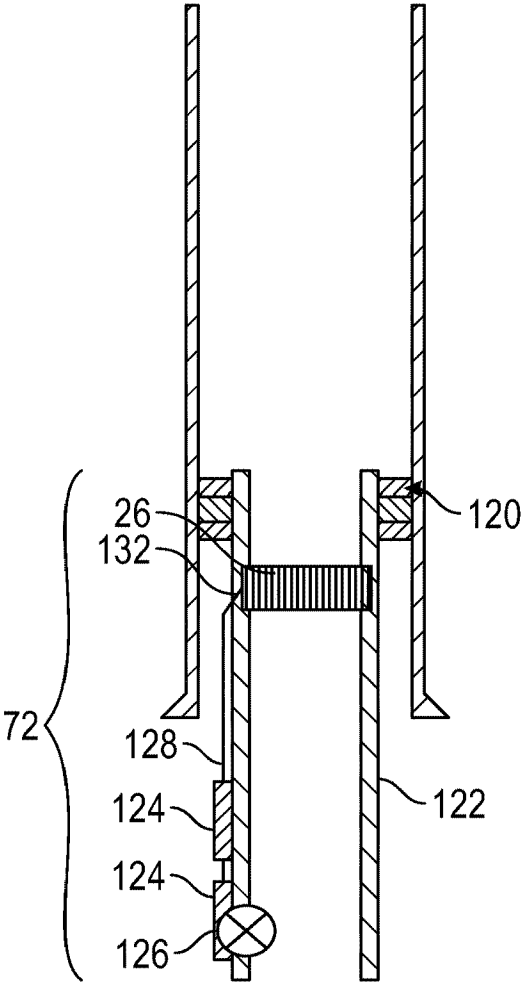
FIG. 7 illustrates a lower completion section of an example multi-stage wireless transmission system.

FIGS. 7 and 8 illustrate another example of a multi-stage wireless transmission system, which includes some of the features of the systems in FIGS. 4 and 5-6 as shown. However, in the lower completion 72 of this system, shown in FIG. 7, the lower coupler 26 is disposed within the production liner 122 and is positioned below the liner hanger 120. The production liner 122 includes a feed-through or penetration 132 for the electrical wiring, e.g., permanent cable, 128 extending from the lower coupler 26 to downhole gauge(s) 124 and/or valve(s) 126. FIG. 8 shows the upper completion 70 deployed in the well and coupled with the lower completion 72 of FIG. 7.

Figure 9:
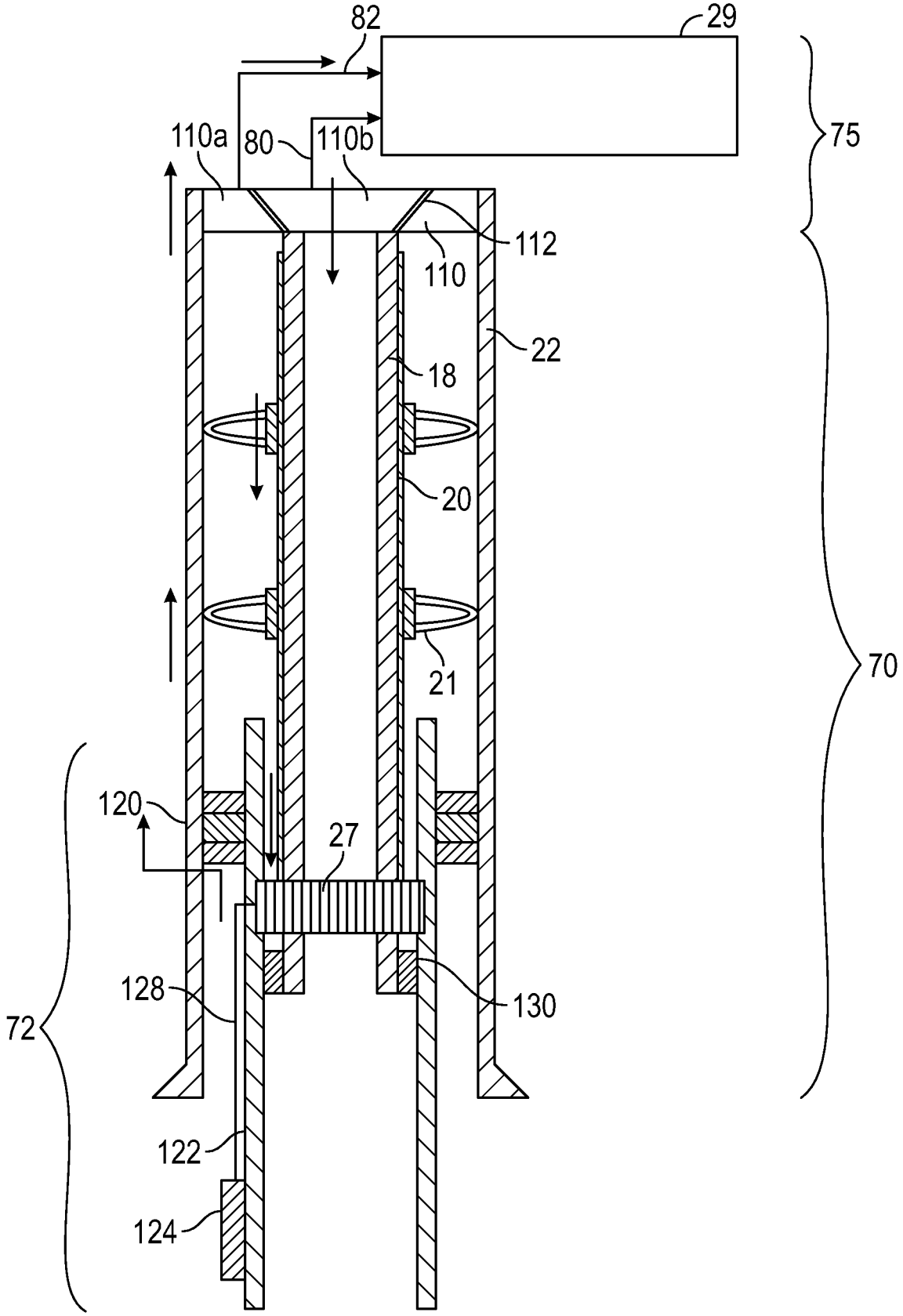
FIG. 9 illustrates an example of a wireless multi-stage completion.

In some configurations, a multi-stage wireless transmission system, for example, any multi-stage wireless transmission system shown and/or described herein and/or otherwise according to the present disclosure, includes an electrically insulated tubing hanger. As shown in FIG. 9, an electrically insulated tubing hanger 110 can be installed on top of the well to allow two distinct electrical conductors or pathways, the casing 22 and the tubing 18, to be available on the surface of the well.

FIG. 9 illustrates an example of a wireless multi-stage completion including an insulated tubing hanger 110. In a wireless multi-stage completion, the tubing 18 and casing 22 can be electrically separated at the tubing hanger 110 by an insulating gap. In the embodiment of FIG. 9, the insulating gap is or includes a layer of ceramic coating 112 in the tubing hanger 110. The layer of ceramic coating 112 is disposed between a completion part 110*a* of the tubing hanger 110 and a part 110*b* of the tubing hanger 110 connected to the tubing 18. Other portions of the surface and/or subsurface tree can also be insulated to avoid shorting the insulation in other locations and to keep the two conductors or pathways separate.

The surface power and telemetry system 29 is connected directly to each of the two separate conductors or pathways at the surface/subsurface (e.g., subsea) interface 75. In the illustrated configuration, the surface system 29 is connected to the tubing 18 pathway via cable 80 and to the casing 22 pathway via cable 82. Such an arrangement allows AC current to be driven directly from the surface into the tubing 18 pathway and returned via the casing 22 pathway. In some configurations, an antenna or coupler 27 is positioned at or near the bottom of the upper completion 70 or at or near a junction between the upper completion 70 and the lower completion 72. When a current is injected into the tubing 18 from surface system 29, the antenna 27 creates a voltage in the lower completion 72. A telemetry signal can be superimposed on an AC power signal to create a telemetry link between the downhole assemblies and the surface system 29. This configuration can advantageously provide a greater power transfer efficiency with only one coupler 27 compared to a system including two couplers. This configuration also advantageously does not require penetrators in the tubing hanger 110, as is often required in a wired system, for example as shown in FIG. 3. This can allow for the use of easier well plugging and abandonment techniques.

Figure 10B:
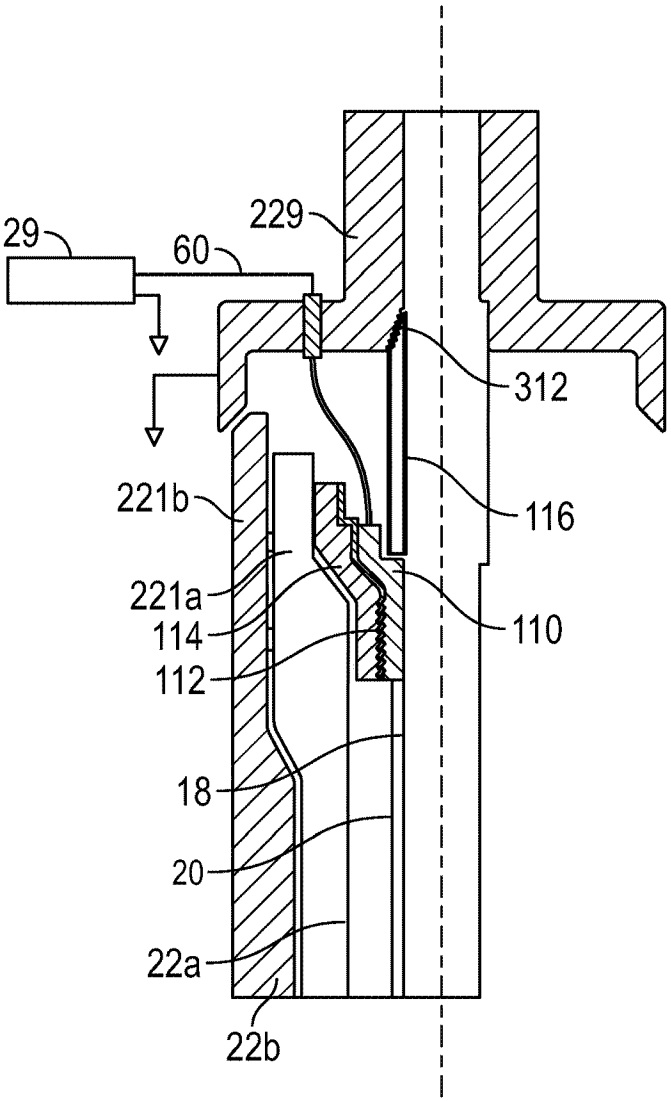
FIG. 10B illustrates an example of an insulated tubing hanger, such as shown in FIG. 10A, as coupled to a well head.
Figure 10A:
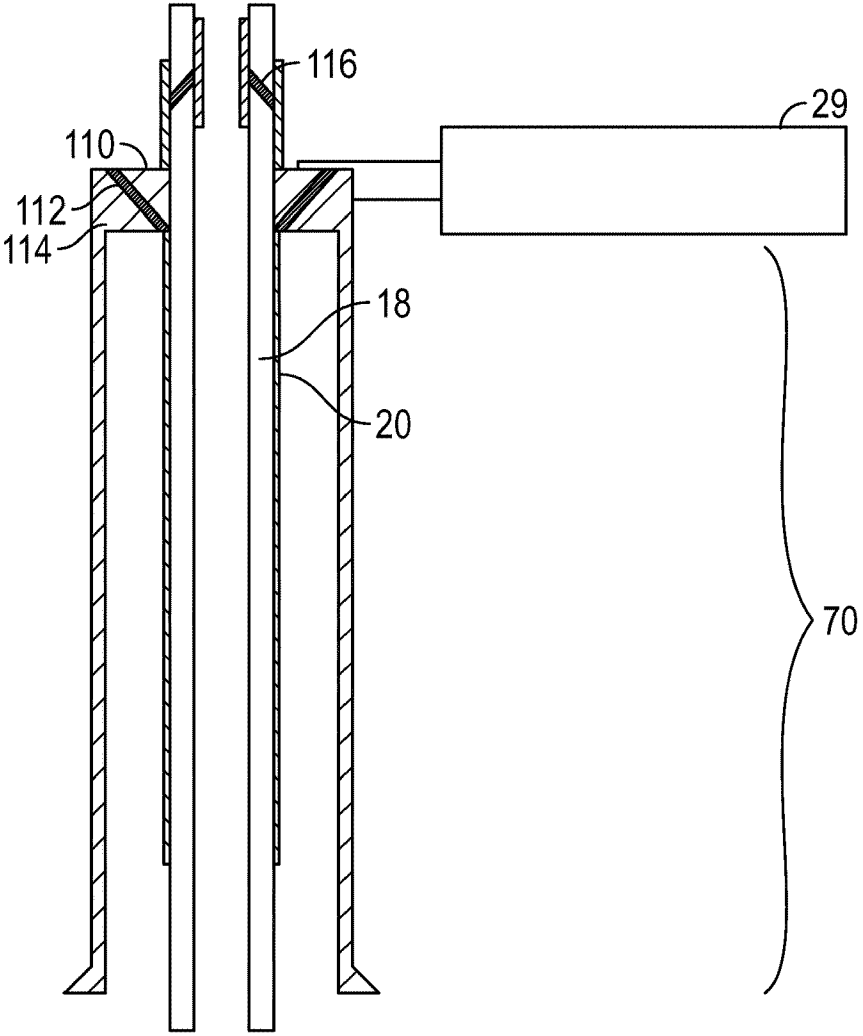
FIG. 10A illustrates an example implementation of an insulated tubing hanger in an upper completion of a wireless multi-stage completion.

FIG. 10A illustrates an example configuration of an insulating tubing hanger 110 that can be used in a multi-stage wireless completion system, such as the system shown in FIG. 9. In the configuration of FIG. 10A, the tubing hanger 110 rests on a tubing seat 114. An interface 112 or surface(s) between the tubing hanger 110 and the tubing seat 114 is insulated. A portion 116 of the tubing 18 located above the tubing hanger 110 is also insulated from the upper part of the surface/subsurface interface to avoid short circuits between the casing 22 and the tubing 18 higher up in the system, for example, due to mechanical fastening or the presence of conductive fluids. The ground terminal of the surface system 29 is connected to the casing 22 assembly, and the positive terminal of the surface system 29 is connected to the insulated part of the tubing hanger 110 assembly as shown.

FIG. 10B illustrates an example configuration of an insulating tubing hanger 110, for example as shown in FIG. 10A, as connected to a well head 229. In the illustrated configuration, the interface 112 between the tubing hanger 110 and the tubing seat 114 is formed via an insulated thread. The thread can be insulated with, for example, a ceramic deposit or epoxy material. In the configuration of FIG. 10B, the casing 22 includes a first casing 22*a* supported by a first casing hanger 221*a* and a second casing 22*b* supported by a second casing hanger 221*b*. As shown in FIG. 10B, the insulated portion 116 of the tubing 18 is coupled to the well head 229, for example, via a threaded connection. An interface 312 or surface(s) between the insulated tubing 116 and the well head 229, e.g., the threaded connection, can be insulated, for example, with a ceramic deposit or epoxy material.

The various couplers 23, 26, 27 used in multi-stage wireless completion systems, such as the systems shown in FIGS. 4-9, can have various constructions. Each coupler 23, 26, 27 can be, include, or act as a toroidal transformer. The primary winding is made of thin wires, which may have a flat geometry, wrapped around a core cylinder of magnetic material (e.g., ferrite or mu-metal). The core cylinder is mounted around the metallic pipe (e.g., tubing 18, production liner 122) such that the secondary winding of the transformer is the metallic pipe itself.

Figure 11:
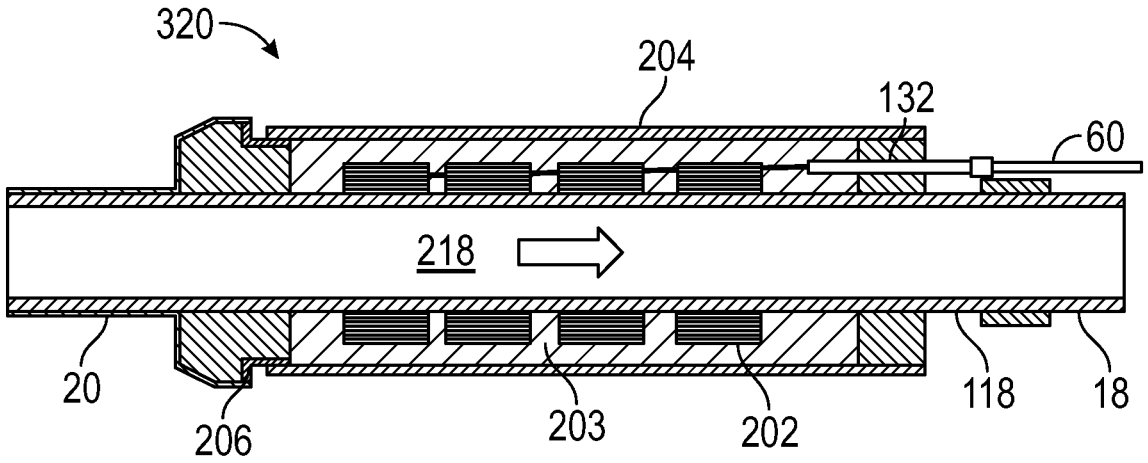
FIG. 11 illustrates an example of an upper coupler for a multi-stage wireless transmission system.
Figure 12:
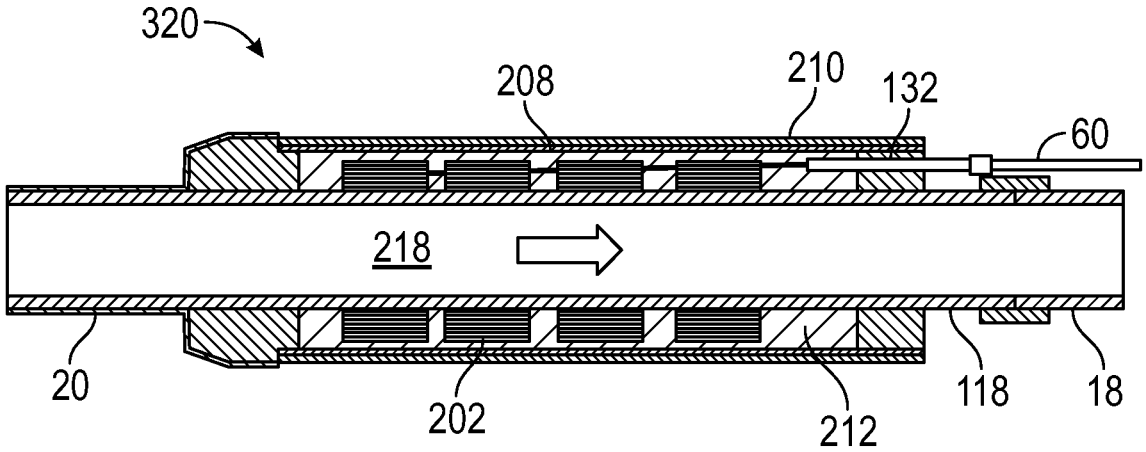
FIG. 12 illustrates an example of an upper coupler for a multi-stage wireless transmission system.
Figure 13:
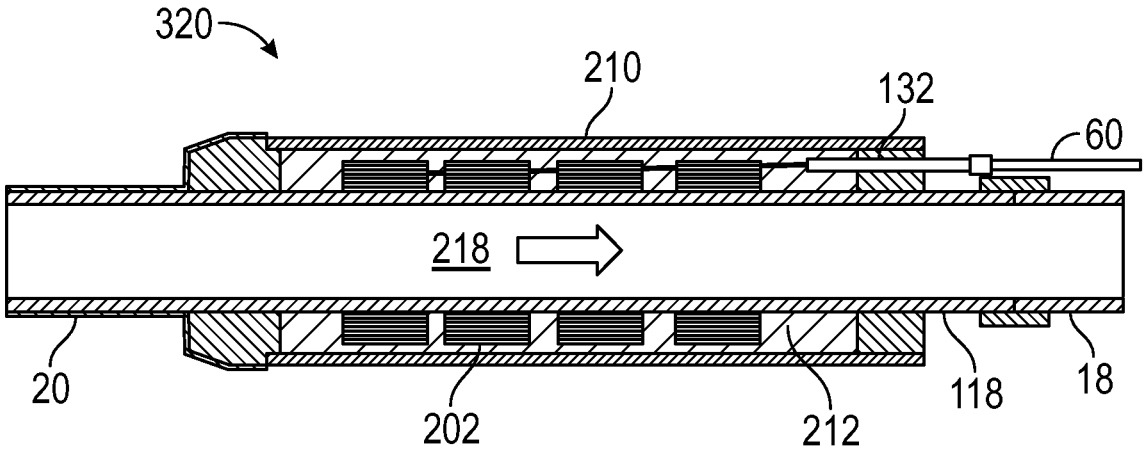
FIG. 13 illustrates an example of an upper coupler for a multi-stage wireless transmission system.
Figure 14:
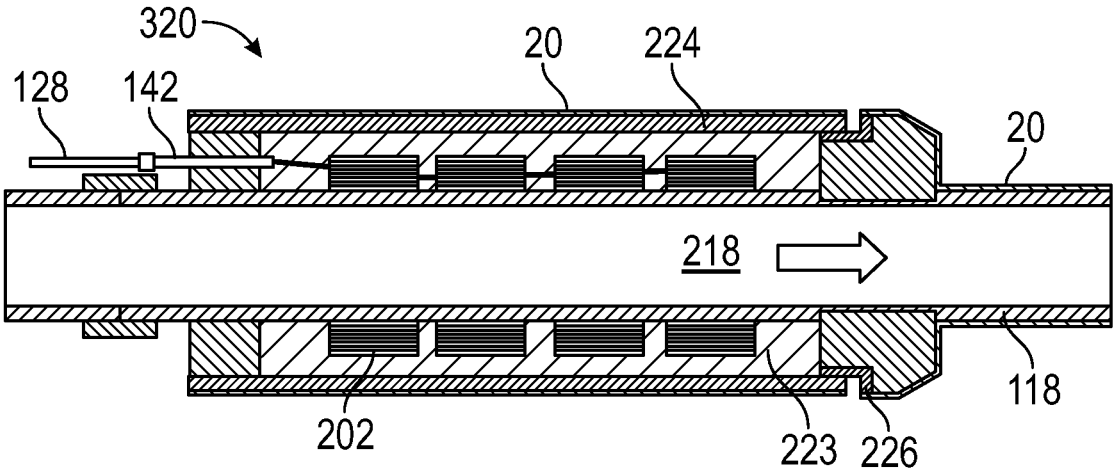
FIG. 14 illustrates an example of a lower coupler for a multi-stage wireless transmission system.
Figure 15:
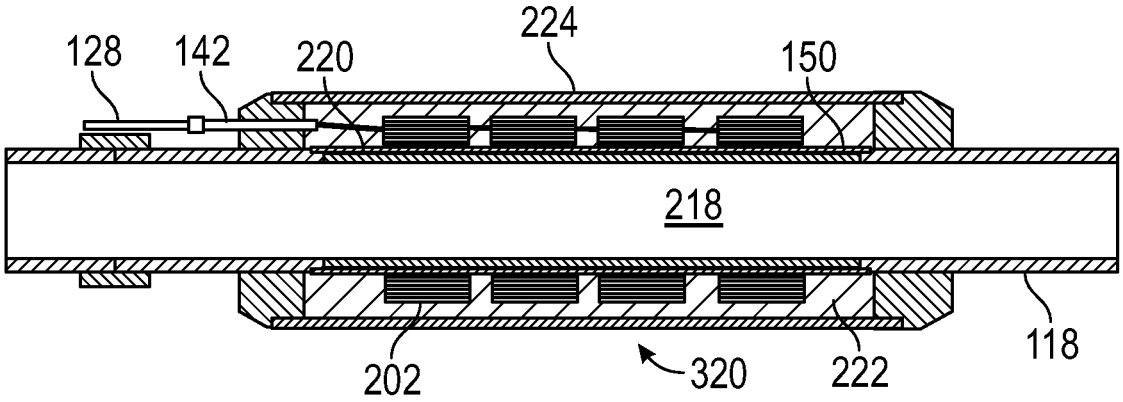
FIG. 15 illustrates an example of a lower coupler for a multi-stage wireless transmission system.
Figure 16:
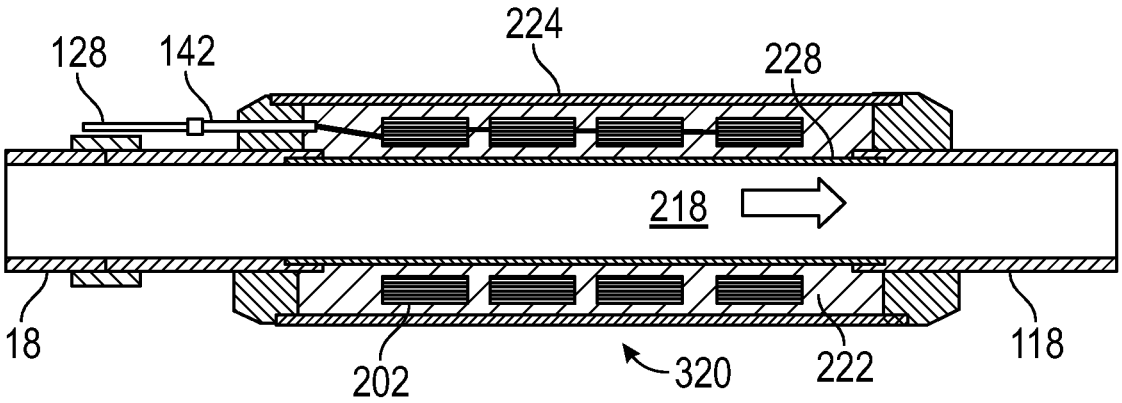
FIG. 16 illustrates an example of a lower coupler for a multi-stage wireless transmission system.

FIGS. 11-13 illustrate example configurations for an upper coupler 23, and FIGS. 14-16 illustrate example configurations for a lower coupler 26. The right side in the orientations of FIGS. 11-16 is positioned toward or extends to the upper well section or uphole. Production fluid 218 is, is disposed in, or flows through a high pressure area. Annular fluid 320 also is, is disposed in, or flows through a high pressure area.

In the embodiment of FIG. 11, toroidal transformers 202 are mounted on and/or around a tubing mandrel 118 (e.g., the production tubing 18) and disposed within a housing 204. The housing 204 can be made of steel. The transformers 202 are at atmospheric pressure. For example, a chamber 203 within the housing 204 can be filled with an inert gas at atmospheric pressure. For improved or optimum efficiency, current propagates only inside the transformers 202. To achieve this, an insulating gap 206, e.g., a ceramic deposit, prevents or inhibits the electrical current from propagating along the housing 204. The gap 206 is disposed between the housing 204 and tubing 18 or between the housing 204 and a mandrel that is disposed around the tubing downhole of the transformers 202 and that can be at least partially coated with an insulating coating 20 along with the portion of the tubing 18 extending downhole. A cable 60 connects the transformers 202 to the surface system for power and telemetry signal transmission and reception.

In the embodiment of FIG. 12, the housing surrounding the transformers 202 includes a thin steel membrane 208 surrounded or overlaid by an insulating coating or sleeve 210. The chamber within the housing surrounding the transformers 202 is filled with an insulating material 212, such as epoxy. For improved or optimum efficiency, current propagates mainly inside the transformers 202. Therefore, the steel membrane 208 is thin to add a resistive path for the current propagating around them.

In the embodiment of FIG. 13, the housing is an insulating sleeve 210, for example, made of PEEK. The chamber within the housing between the tubing 18 and the sleeve 210 is filled with an insulating material 212, such as epoxy. The sleeve 210 prevents or inhibits electrical current from propagating around the transformers 202 such that current propagates only inside the transformers 202 for improved or optimum efficiency.

FIGS. 14-16 illustrate example configurations for a lower coupler 26. In the embodiment of FIG. 14, the toroidal transformers 202 are mounted on and/or around a steel mandrel 118 (e.g., the production tubing 18) and disposed within a housing 224. The housing 224 can be made of steel. In some configurations, an outer surface of the housing 224 is coated with an insulating coating 20. The transformers 202 are at atmospheric pressure. For example, a chamber 223 within the housing 224 can be filled with an inert gas at atmospheric pressure. For improved or optimum efficiency, current propagates only inside the transformers 202. To achieve this, an insulating gap 226, e.g., a ceramic deposit, prevents or inhibits the electrical current from propagating along the housing 224. The gap 226 is disposed between the housing 224 and tubing 18 or between the housing 224 and a mandrel that is disposed around the tubing uphole of the transformers 202. The mandrel can be at least partially coated with an insulating coating 20 along with the portion of the tubing 18 extending uphole. A cable 128 connects the transformers 202 to one or more downhole devices, e.g., gauges, valves, and/or electrical units, for power and telemetry signal transmission and reception. A feedthrough connector 142 can couple the cable 128 to the transformers 202.

In the embodiment of FIG. 15, the toroidal transformers 202 are mounted on and/or around a thin metallic sleeve or membrane 150 and disposed within a housing 224. The housing 224 can be made of steel. The chamber within the housing 224 and surrounding the transformers 202 is filled with an insulating material 222, such as epoxy. For improved or optimum efficiency, current propagates mainly outside the toroidal transformers 202. Therefore, the metallic sleeve 150 is thin to add a resistive path for the current propagating inside the toroidal transformers 202. An inner surface of the sleeve 150 exposed to inner fluids (e.g., production fluids) is coated with an insulating material 220, such as rilsan. The insulating coating 220 increase the coupler efficiency in case of conductive fluids.

In the embodiment of FIG. 16, the transformers 202 are mounted on and/or around an electrically insulating sleeve 228, for example, made of PEEK, and disposed within a housing 224, which can be made of steel. The chamber within the housing 224 and surrounding the transformers 202 is filled with an insulating material 222, such as epoxy. The electrically insulated sleeve 228 can prevent or inhibit current from propagating inside the transformers 202. For improved or optimum efficiency, the current propagates mainly outside the transformers 202.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A wireless transmission system for a multi-stage completion, comprising:

a surface power and telemetry system;

an upper completion comprising a casing, a production tubing disposed within the casing, a tubing hanger supporting the production tubing, and an upper coupler, wherein the upper coupler includes a plurality of toroidal transformers disposed on an outer surface of the production tubing, and wherein the upper coupler is configured to receive power and telemetry signals from a first cable extending from the surface power and telemetry system and induce a current in the production tubing, wherein the upper coupler further comprises an outer housing disposed about the plurality of toroidal transformers, wherein a space between the outer housing of the upper coupler surrounding the plurality of toroidal transformers is filled with an insulating material or inert gas at atmospheric pressure;

a lower completion comprising a production liner, a liner hanger disposed within the casing and supporting the production liner, a lower coupler comprising a second plurality of toroidal transformers surrounded by a second outer housing, and one or more downhole devices, wherein a second cable extends from the lower coupler to the one or more downhole devices;

wherein in use, the power and telemetry signals flow from the surface power and telemetry system along the first cable to the upper coupler, the power and telemetry signals flow from the upper coupler along the production tubing downhole to the lower coupler, the power and telemetry signals flow from the lower coupler along the second cable to the one or more downhole devices, and return telemetry signals flow from the lower completion along the casing to the surface power and telemetry system.

2. The wireless transmission system of claim 1, wherein the lower coupler is disposed around the production liner and positioned above the liner hanger.

3. The wireless transmission system of claim 1, wherein the lower coupler is disposed within the production liner and positioned below the liner hanger.

4. The wireless transmission system of claim 1, wherein the one or more downhole devices comprises one or more downhole gauges.

5. The wireless transmission system of claim 1, wherein the one or more downhole devices comprises one or more flow control valves.

6. The wireless transmission system of claim 1, wherein a space between the outer housing of the lower coupler surrounding the second plurality of toroidal transformers is filled with an inert gas at atmospheric pressure.

7. The wireless transmission system of claim 1, wherein a space between the outer housing of the lower coupler surrounding the second plurality of toroidal transformers is filled with an insulating material.

8. A multi-stage completion, comprising:

an upper completion comprising a casing, a production tubing disposed within the casing, a tubing hanger supporting the production tubing, and an upper coupler, wherein the upper coupler includes a plurality of toroidal transformers disposed on an outer surface of the production tubing, wherein the upper coupler further comprises an outer housing disposed about the plurality of toroidal transformers, wherein a space between the outer housing of the upper coupler surrounding the plurality of toroidal transformers is filled with an insulating material or inert gas at atmospheric pressure, and wherein the upper coupler is configured to receive power and telemetry signals from a surface power and/or telemetry system and induce a current in the production tubing; and a lower completion comprising a production liner, a liner hanger disposed within the casing and supporting the production liner, a lower coupler comprising a second plurality of toroidal transformers surrounded by a second outer housing, and one or more downhole devices; wherein in use, the power and telemetry signals flow from the surface power and/or telemetry system to the upper coupler, the power and telemetry signals flow from the upper coupler along the production tubing downhole to the lower coupler, the power and telemetry signals flow from the lower coupler to the one or more downhole devices, and return telemetry signals flow from the lower completion along the casing to the surface power and telemetry system.

9. The multi-stage completion of claim 8, wherein the lower coupler is disposed around the production liner and positioned above the liner hanger.

10. The multi-stage completion of claim 8, wherein the lower coupler is disposed within the production liner and positioned below the liner hanger.

11. The multi-stage completion of claim 8, wherein the one or more downhole devices comprises one or more downhole gauges and/or one or more flow control valves.

12. The multi-stage completion of claim 8, wherein the second plurality of toroidal transformers are disposed about the production tubing.

13. The multi-stage completion of claim 12, wherein a space between the outer housing of the lower coupler surrounding the second plurality of toroidal transformers is filled with an inert gas at atmospheric pressure.

14. The multi-stage completion of claim 12, wherein a space between the outer housing of the lower coupler surrounding the second plurality of toroidal transformers is filled with an insulating material.

* * * * *